United States Patent [19]

Messinger et al.

[11] Patent Number: 5,007,168

[45] Date of Patent: Apr. 16, 1991

[54] ELECTRIC DRY SHAVING APPARATUS WITH A MOVABLE SHAVING HEAD ARRANGEMENT

[75] Inventors: Werner Messinger, Kronberg; Karl Trölltsch, Frankfurt am Main; Bernd Tewes, Wiesbaden, all of Fed. Rep. of Germany

[73] Assignee: Braun Aktiengesellschaft, Frankfurt, Fed. Rep. of Germany

[21] Appl. No.: 453,718

[22] Filed: Dec. 20, 1989

[30] Foreign Application Priority Data

Dec. 24, 1988 [DE] Fed. Rep. of Germany ..... 3843936

[51] Int. Cl.[5] ..... B26B 19/20; B26B 19/14; B26B 19/16; B26B 19/44

[52] U.S. Cl. ..... 30/43; 30/43.5; 30/43.6; 30/41.5

[58] Field of Search ..... 30/41, 41.5, 41.2, 41.6, 30/41.9, 42, 43, 43.2, 43.3, 43.4, 43.5, 43.6, 43.9

[56] References Cited

U.S. PATENT DOCUMENTS

| | | | |
|---|---|---|---|
| 3,369,294 | 2/1968 | Shaw et al. | 30/41.5 |
| 3,800,417 | 4/1974 | Tietjens | 30/43.6 |
| 3,844,033 | 10/1974 | Yonkers | 30/43.6 |
| 4,001,932 | 1/1977 | Herrick | 30/43.5 |
| 4,038,747 | 8/1977 | Upton | 30/43.5 |
| 4,168,570 | 9/1979 | Bakker et al. | 30/43.6 |
| 4,896,421 | 1/1990 | Gertsma et al. | 30/43.6 |
| 4,910,869 | 3/1990 | Labrijn | 30/43.6 |

FOREIGN PATENT DOCUMENTS

| | | |
|---|---|---|
| 176128 | 4/1986 | European Pat. Off. . |
| 1034515 | 7/1958 | Fed. Rep. of Germany . |
| 53-106256 | 9/1978 | Japan . |

*Primary Examiner*—Douglas D. Watts
*Assistant Examiner*—Paul M. Heyrana, Sr.
*Attorney, Agent, or Firm*—Fish & Richardson

[57] ABSTRACT

The invention is directed to an electric dry shaving apparatus with a housing, a movably carried shaving head, a shaving assembly including at least one circular upper cutter and rotary lower cutter and having its axis of rotation at right angles to a shearing plane extending parallel to the outer surface of the upper cutter. The movable shaving head axis of symmetry intersects the shearing plane in any direction in the geometric center of the shaving assemblies. The geometric center is provided as the stationary pole.

19 Claims, 4 Drawing Sheets

ELECTRIC DRY SHAVING APPARATUS WITH A MOVABLE SHAVING HEAD ARRANGEMENT

This invention relates to an electric dry shaving apparatus with a housing, a movably carried shaving head in which at least one shaving assembly is provided which includes a circular upper cutter and a rotary lower cutter and has its axis of rotation aligned at right angles to a shearing plane extending parallel to the outer surface of the upper cutter, and with a shaving head axis of symmetry intersecting the shearing plane at right angles in the geometric center of the shaving assembly or assemblies provided.

An electric shaver with a shaving head accommodating two or three rotary shaving assemblies is already known (EP-A 0 176 128). The shaving head of FIGS. 7 and 8 is arranged to be rotatable about a fixed axis of symmetry of the shaving head passing through the geometric center of the three shaving assemblies provided, such that the position of the shearing plane extending parallel to the outer surface of the upper cutters of the shaving assemblies relative to the shaver housing is not altered. The shaving head of FIG. 9 is carried between mounting arms provided on the shaver housing. The pivotal axis of the shaving head is provided below the shearing plane of the rotary shaving assemblies at a relatively large distance therefrom. Because of the relatively large distance between the shearing plane of the shaving assemblies and the pivotal axis, the forces bearing vertically on the shearing plane, in combination with the respective thrust at which the shearing plane is moved over the skin surface, produce a torque which, in a sliding direction, turns the shearing plane into engagement with the skin surface, while in the direction opposite the sliding direction causing the shearing plane to disengage from the skin surface. The greater the distance between the shearing plane and the pivotal axis, the greater is the torque producing a disengagement effect, so that constant engagement of the shearing plane of the shaving assemblies provided with the skin is not ensured.

It is an object of the present invention to movably arrange the shaving head of a shaver in such fashion that the entire shearing area usable for a shave engages the skin surface with the shaver housing held against the skin at customary angles, and that disengagement of the shearing area or part of the usable shearing area from the skin surface is prevented from occurring with varying loads or directions of sliding motion of the shaving head on the skin surface. To ensure a perfect shave, the entire usable shearing area is to be in a position to readily follow the skin contour, independently of the individual forces bearing thereon.

According to the invention, this requirement is satisfied in an apparatus of the type initially referred to in that the geometric center is provided as the stationary pole for the shaving head axis of symmetry which is movable with the shearing plane in any direction. By mounting the shaving head in this manner, it is ensured that, within the customary angles at which the shaving head of the shaver is held against the skin surface, the shearing areas of the shaving assembly or assemblies provided are automatically moved into engagement with the skin surface in the form of a shearing plane and remain engaged therewith, regardless of the forces bearing on this shearing plane and varying directions of sliding motion of the shaving head over the skin surface.

It is a particular advantage of this balanced mounting of the shaving head that the individual bearing forces exerted through the shaver handle are evenly distributed over the effective shearing areas following engagement of the shearing plane with the skin surface. Because the pole of the shaving head and thus of the shaving assembly or assemblies provided lies in the geometric center of the shearing areas provided, the shaving head arrangement is capable of oscillating very easily, thus following directly the contour of the skin.

The advantage afforded by accomplishing the object of the invention continues to exist also in the event of a minor displacement and/or deformation of the shearing plane relative to the stationary pole resulting from an elastic and/or tiltable mounting of the shaving assembly or assemblies. Such temporary geometrical variations are therefore within the scope of the protection afforded by the main claim.

Advantageously, the shearing plane and the shaving head axis of symmetry are movable about three spatial axes passing through the pole at relative right angles.

Conveniently, with this arrangement the joint movement of the shearing plane and the shaving head axis of symmetry is adapted to be limited by stop means provided on the shaving head and on the housing.

In an advantageous embodiment of the invention, the housing of the shaving head is configured as a spherical shell at least in part, the spherical shell being pivotally mounted in a bearing shell provided in the housing of the shaving apparatus in the form of a spherical calotte. The radii of the spherical shell and the bearing shell have their common center in the pole.

Further advantageous embodiments of the invention will become apparent from the characterizing parts of the subclaims 6 to 9.

If it is desired to limit the pivotal movement of the shaving head about all three spatial axes x, y and z to a movement about the two spatial axes x and y only, a further advantageous embodiment of the invention provides positive-engagement guiding means in the region of the spherical shell of the shaving head and the bearing shell of the housing, the means being in such relative orientation as to inhibit movement about the vertical spatial axis z. For this purpose, an advantageous improvement of the invention provides a separate coupling member engaging into the guiding means of both the spherical shell and the bearing shell. Preferably, the coupling member is provided with rib members and blocks intersecting with each other at right angles, and the coupling member is adapted to be mounted on the concave side of the spherical shell and, extending with its blocks through correspondingly dimensioned recesses in the spherical shell, engages into guiding means of the bearing shell.

To further limit the movement of the shaving head about only one axis x or y, an improvement of the invention conveniently provides only one positive-engagement guiding means between the shaving head and the housing.

Further advantages and details of the invention will become apparent from the subsequent description and the accompanying drawings illustrating some preferred embodiments. In the drawings, FIG. 1 is a schematic view of an electric dry shaving apparatus having a shaving head in which three shaving assemblies equipped with rotary lower cutters are arranged in one shearing plane and are pivotal about a stationary pole together with the shaving head frame in any direction;

Figure 1:
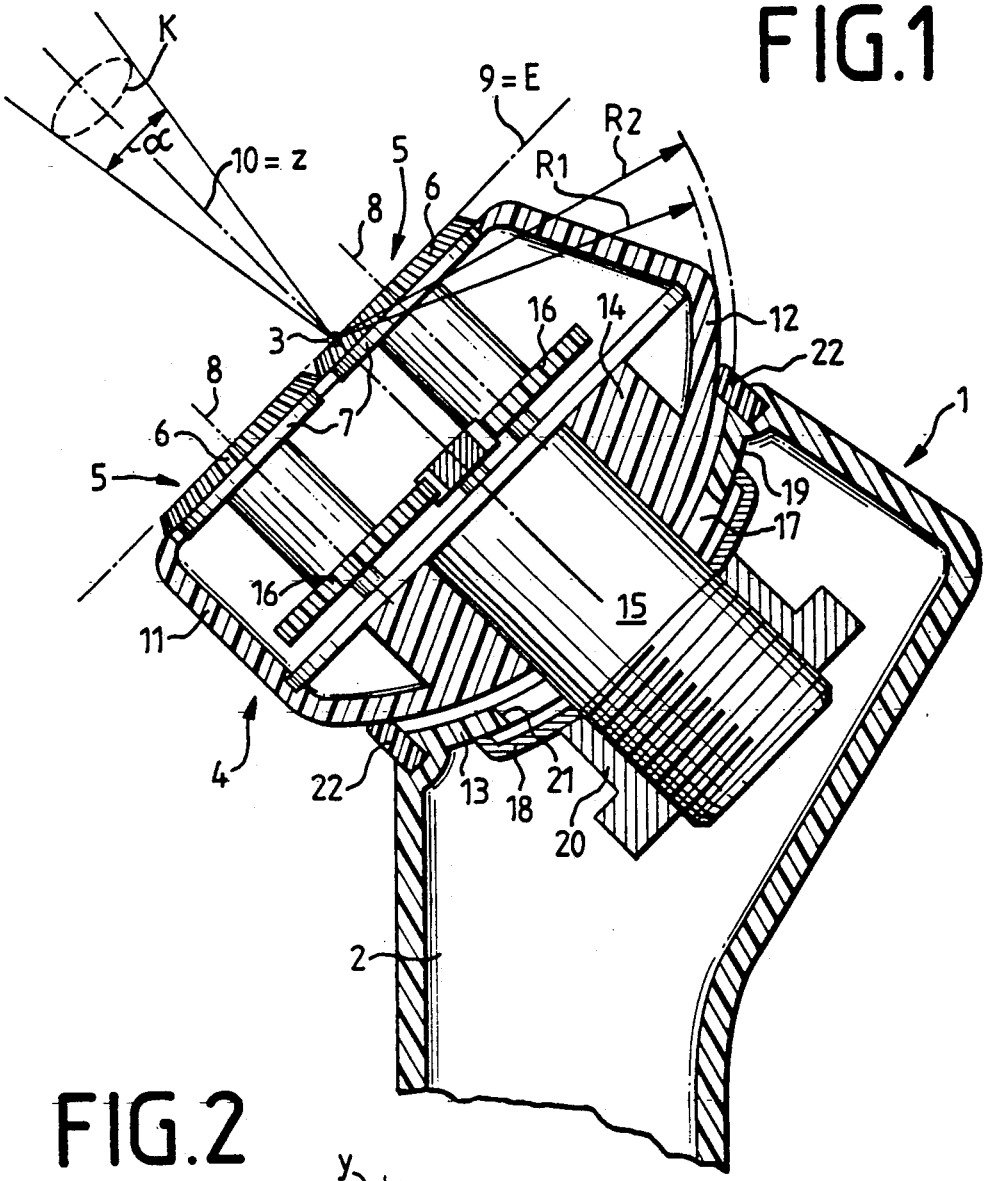

Referring now to FIG. 1, there is shown an electric dry shaving apparatus 1 with a housing 2 serving as a handle and a shaving head 4 movable about a stationary pole 3 and incorporating three shaving assemblies 5 two of which are shown in the illustration. The shaving assemblies 5 are each comprised of a circular upper cutter 6 and a rotary lower cutter 7 in cooperative relation therewith and have their axes of rotation 8 aligned at right angles to the shearing plane E formed by the outer surfaces 9 of the upper cutters 6. In the embodiment of FIG. 1, the stationary pole 3 lies level with the shearing plane E, its accurate position in the shearing plane E being determined by the geometric center of the shaving assemblies 5 provided, as will be explained in more detail with reference to FIG. 2. The shaving head axis of symmetry 10 intersecting the shearing plane E at right angles passes through the pole 3, executing in conjunction with the shearing plane E all pivotal movements of the shaving head 4 about the stationary pole 3.

This pivotal or wobbling movement of the shaving head 4 about the stationary or fixed pole 3 may also be described as a pivotal movement about three stationary spatial axes x, y, z passing through this pole 3 and aligned at right angles to each other, wherein in the mid-position of the shaving head 4, that is, in the non-pivoted position, the spatial axes x and y lie in the shearing plane E while the spatial axis z coincides with the shaving head axis of symmetry 10; accordingly, the shaving head 4 has three degrees of freedom. The housing 11 of the shaving head 4 is configured as a spherical shell 12 at least in part, that is, on the housing side opposite the outer surface 9, the spherical shell being movable in any direction in a bearing shell 13 provided in the housing 2 in the form of a spherical calotte. The radius $R_1$ of the spherical shell 12 and the radius $R_2$ of the bearing shell 13 have their common center in the pole 3.

Secured to a mount 14 in the housing 11 is an electric motor 15 which is coupled to the lower cutters 7 of the shaving assemblies 5 provided by means of a gearing 16 in order to cause them to rotate on energization of the motor. The motor 15 which is arranged concentrically with the shaving head axis of symmetry 10 in the shaving head 4 extends out of the housing 11 into the housing 2 through an opening 17 provided concentrically with the mid-point of the bearing shell 13 configured in the form of a spherical calotte. The motor is surrounded by dish-shaped slide bearing member 18 which is held in sliding engagement with the convex wall 19 of the bearing shell 13 on the side facing the interior of the housing 2 by means of a bushing 20 adapted to be threaded onto the motor 15.

With this arrangement, the shaving head 4 is slidably secured to the housing 2 by means of the motor 15, the slide bearing member 18 and the bearing shell 13. The diameter of the opening 17 and thus of the shaving head 4 is greater than the outside diameter of the motor 15. The periphery of the opening 17 serves as a stop means 21 for limiting the freedom of movement of the motor 15 inside the opening 17. The size of the opening 17 is dimensioned such that, starting from the mid-position of the shaving head 4 in which its axis of symmetry 10 passes through both the center of the opening 17 and the pole 3, the shaving head axis of symmetry 10, together with the shearing plane E, is capable of executing an angular movement $\alpha$ about the stationary pole 3 in any direction, that is, a wobbling motion about the pole 3 of up to 20°, approximately, as indicated by the circle K about the spatial axis z.

To prevent particles of dirt, especially hair dust, from entering the interior of the housing 2, a seal 22 is provided between the spherical shell 12 and the bearing shell 13 preferably in the region of its outer periphery, and the seal may be made of a plastics or ceramic material and, in addition to its sealing function, may also serve the supporting function of the bearing shell 13. Further, by selecting appropriate materials for the spherical shell 12 or the seal 22, it is possible to adjust the friction between the two components, and by selecting the bearing force by means of the bushing 20, it is possible to adjust the ease of motion and the damping of motion of the movable shaving head 4.

Figure 2:
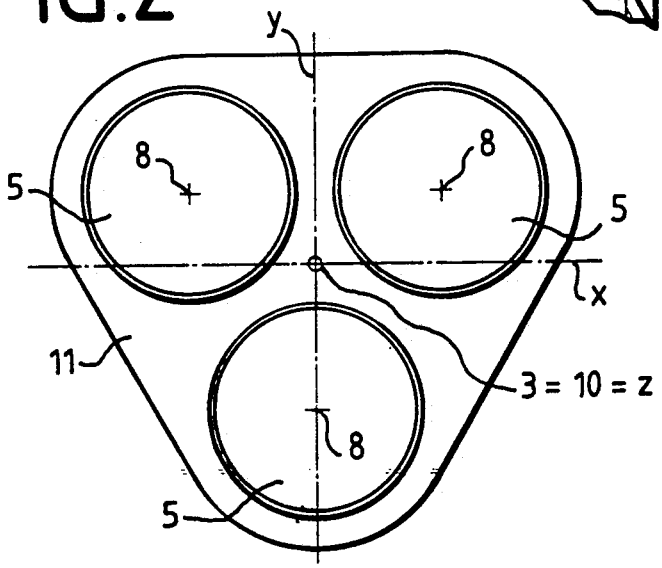
FIG. 2 is a top plan view of the shaving head of FIG. 1.

As becomes apparent from FIG. 2, the three shaving assemblies 5 are arranged on the outer surface 9 of the shaving head 4 in such fashion that the three axes of rotation 8 lie in the corners of an isosceles triangle whose center of gravity as the geometric center is identical with the stationary pole 3. Passing through its mid-point or pole 3 are the shaving head axis of symmetry 10 which is perpendicular to the shearing plane E and, with the shaving head 4 in mid-position, also the spatial axis z. Further, the spatial axes x and y lying in the shearing plane E are also shown.

Figure 3:
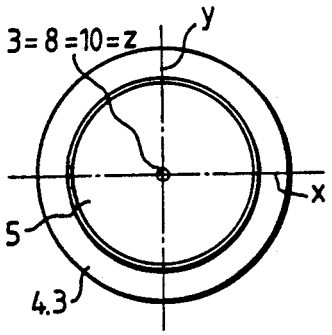
FIGS. 3 to 6 are top plan views of four shaving heads illustrating the shaving assembly or assemblies in various arrangements and numbers and their positions relative to the stationary pole.

In FIG. 3, the shaving head 4.3 possesses only one shaving assembly 5. The pole 3 is at the same time the geometric center of the shaving head 4.3, having passing therethrough the shaving head axis of symmetry 10 and the spatial axis z, perpendicular to the plane of projection which is also the shearing plane E in this embodiment. The spatial axes x and y lie in the shearing plane E and pass through the pole 3; passing through the pole is also the axis of rotation 8 of the shaving assembly 5.

Figure 4:
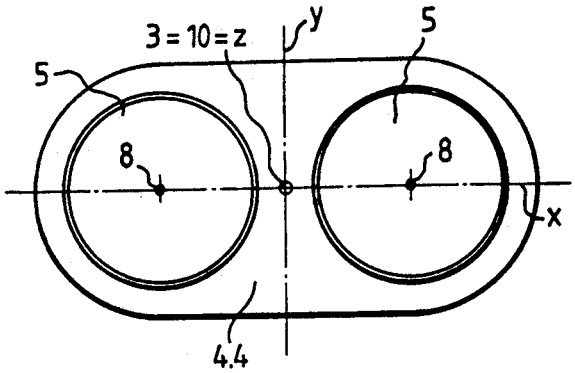

In FIG. 4, the shaving head 4.4 has two shaving assemblies 5; the pole 3 lies in the center of the line connecting the axes of rotation 8 and thus in the geometric center, having passing therethrough both the shaving head axis of symmetry 10 and the spatial axis z perpendicular to the plane of projection=shearing plane E, and the spatial axes x and y lying in that plane.

Figure 5:
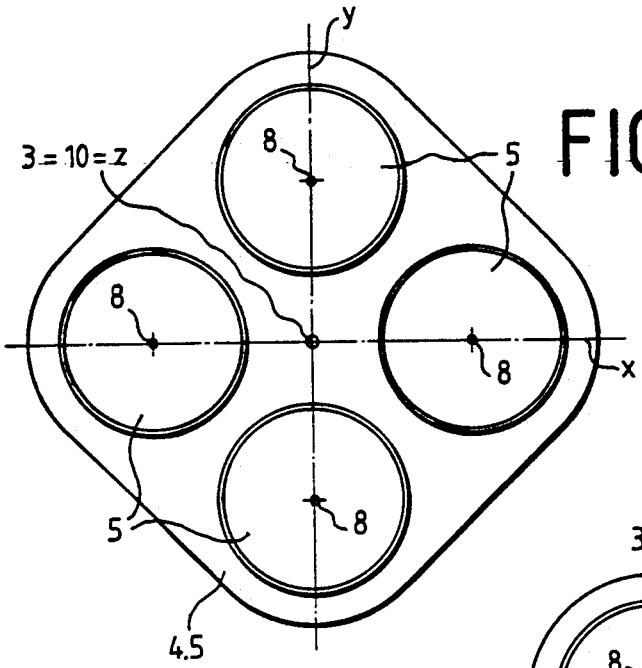

In FIG. 5, the shaving head 4.5 includes four shaving assemblies 5 having their axes of rotation 8 in the corners of a square standing on end. The geometric center lies in the point of intersection of the diagonals of the square which in this embodiment are identical with the spatial axes x and y, being at the same time the pole 3 through which the spatial axis z and the shaving head axis of symmetry 10 pass—perpendicular to the plane of projection.

Figure 6:
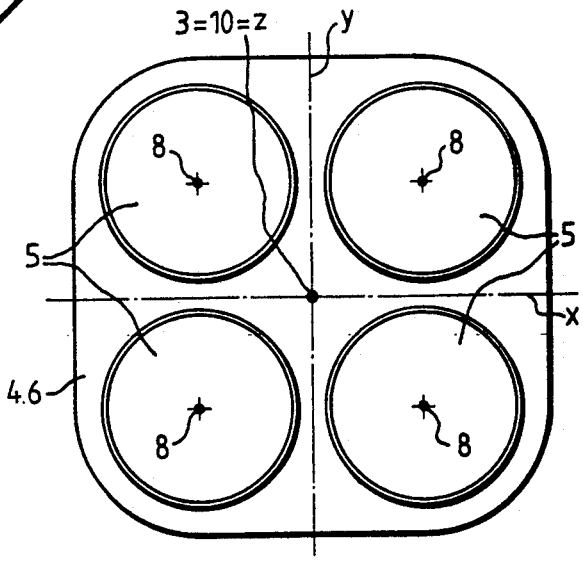

In FIG. 6, the shaving head 4.6 equally includes four shaving assemblies 5 having their axes of rotation 8 in the corners of a square having arranged in its geometric center in the manner described in the foregoing the pole 3, the shaving head axis of symmetry 10 and the vertical spatial axis z, the arrangement, however, being such that the spatial axes x and y passing through the pole 3 are parallel to the sides of the square.

Figure 8:
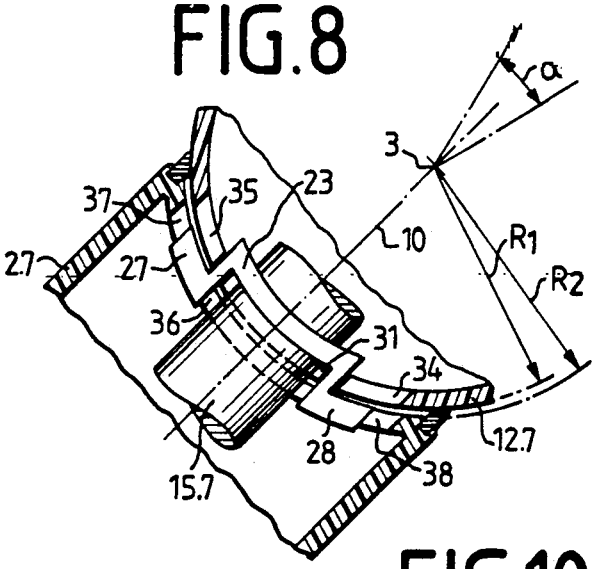
FIG. 8 is a schematic view taken along the line 8—8 of FIG. 7.
Figure 7:
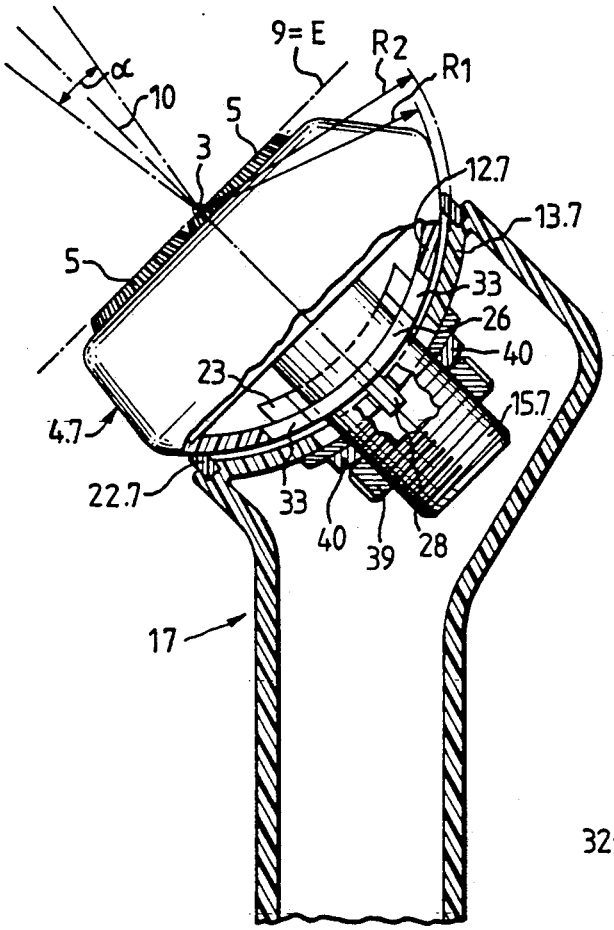
FIG. 7 is a schematic view of a further embodiment of an electric dry shaving apparatus in which the shaving head is pivotal in two directions.
Figure 10:
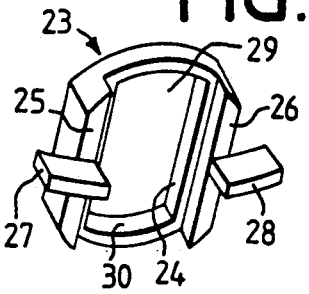
FIG. 10 is a perspective view of a further detail of FIG. 7.
Figure 9:
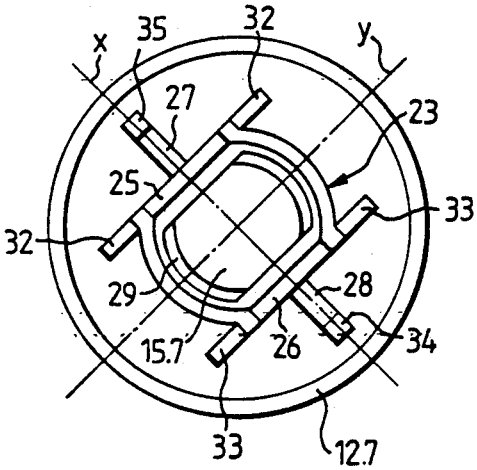
FIG. 9 is a top plan view of a detail of FIG. 7.

The electric dry shaving apparatus 1.7 of FIG. 7 is of a structure similar to the one shown in FIG. 1; it includes a housing 2.7 serving as a handle, a shaving head 4.7 provided with the rotary shaving assemblies 5, and an electric motor 15.7 mounted in the head. In this embodiment, too, the shearing plane E is defined as the outer surface 9 of the shaving assemblies 5. The shaving head axis of symmetry 10 extends through the shearing plane E in the stationary pole 3 having also extending therethrough in the mid-position of the shaving head 4.7 the spatial axes x and y lying in the shearing plane E (FIG. 9). Further, on its side opposite the shearing plane E, the shaving head 4.7 is equally configured in the manner of a spherical shell 12.7 which, as in the embodiment of FIG. 1, corresponds with a spherical calotte type bearing shell 13.7 of the housing 2.7. A seal 22.7 is likewise arranged between the two shells 12.7 and 13.7. The common center of the two radii $R_1$ and $R_2$ of the shells 12.7 and 13.7, respectively, is the pole 3. To determine the extent of pivotal motion of the shaving head 4.7 exclusively about the spatial axes x and y, which excludes a pivotal motion about the vertical axis z or the shaving head axis of symmetry 10, positive-engagement guiding means acting between the shells 12.7 and 13.7 are provided which will be described in more detail in the following with reference to FIGS. 8, 9 and 10. The core of these guiding means is a coupling member 23 having two parallel rib members 25 and 26 on its longitudinal sides 24, with two freely outwardly protruding blocks 27 and 28 being seated on the centers of the rib members transversely thereto and serving as guiding elements transversely to the guiding direction of the rib members 25 and 26. Provided in the center of the coupling member 23 is an opening 29 for the motor 15.7, which opening is dimensioned such that its longitudinal sides 24 snugly engage the motor, that is, parallel to the rib members 25 and 26, while a clearance is maintained between the transverse sides 30, that is, parallel to the blocks 27 and 28, and the corresponding dimensions of the motor 15.7, to allow movement of the motor 15.7 relative to the coupling member 23 within the limits of the selected pivotal motion of the shaving head 4.7. Provided in the spherical shell 12.7 of the shaving head 4.7 are a central opening 31 dimensioned to correspond to the cross-section of the motor (see FIG. 8), slot-type recesses 32, 33 for the rib members 25, 26, and recesses 34, 35 for the blocks 27, 28. FIG. 9 illustrates the respective relationships in a top plan view, showing schematically the concave side of the spherical shell 12.7 with the coupling member 23 inserted. Correspondingly, the bearing shell 13.7 of the housing 2.7 includes a central opening 36 for the motor 15.7 which is provided with positive allowance relative to the cross-sectional dimensions of the motor, such that the motor 15.7 is free to move with the shaving head pivoting in the directions of the spatial axes x and y. Adjacent to either side of this opening 36—in accordance with the representation of FIG. 9—in the center of its longitudinal edges are recesses 37 and 38 (FIG. 8) which are provided transversely to the direction of extension of the rib members 25 and 26. These recesses 37 and 38 are engaged by the blocks 27 and 28, respectively, for the purpose of guiding the pivotal motion of the shaving head 4.7 about the spatial axis y. Their length is determined by the selected amount of deflection of the pivotal motion. For assembly, the coupling member 23 is slipped onto the motor 15.7 prior to its fastening in the shaving head 4.7, until the rib members 25, 26 engage into their respective recesses serving as guiding means and until the blocks 27, 28 extend through the recesses 34, 35 in order to engage in their respective recesses 37, 38 in the bearing shell 13.7 serving as guiding means. Also in this embodiment, a bushing 39 is used for clamping the shaving head 4.7 relative to the bearing shell 13.7 of the housing 2.7, the bushing being adapted to be threaded onto the motor 15.7, bearing through a slide bearing member 40 against the convex side of the bearing shell 13.7. The narrow sides of the slot-type recesses serve as stop means to limit the pivotal movements of the shaving head.

Figure 11:
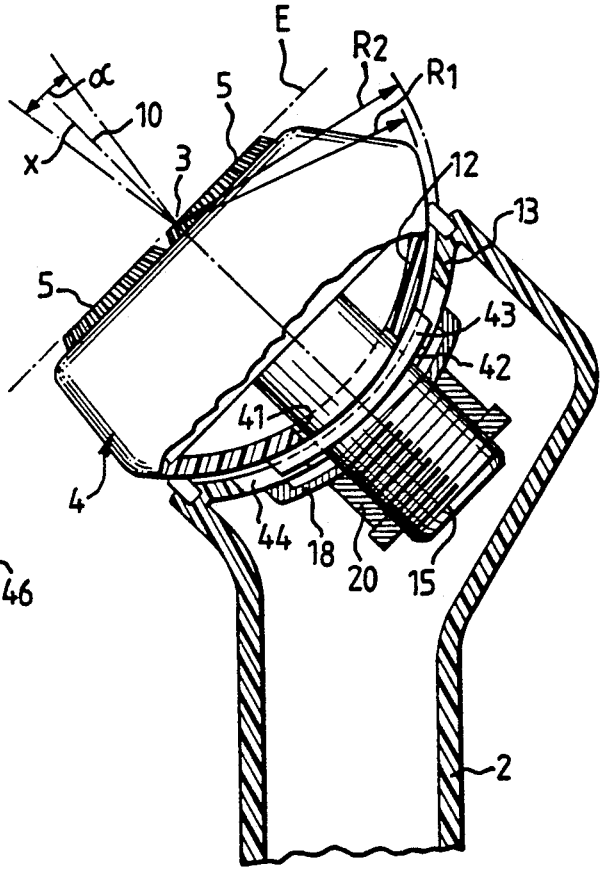
FIG. 11 is a schematic view of a further embodiment of an electric dry shaving apparatus in which the shaving head is pivotal in one direction.

In the embodiment of a dry shaving apparatus shown in FIG. 11, a pivotal motion is provided about one spatial axis only, the axis x, which passes through the pole 3. Movements about the spatial axes y and z are blocked. Otherwise, the structural design corresponds to the embodiment of FIG. 1. The pole 3 lies in the point of intersection of the shaving head axis of symmetry 10 with the shearing plane E which is determined by the surface of the shaving assemblies 5. The electric motor 15 for driving the shaving assemblies 5 is secured in the shaving head 4, extending through the underside of the shaving head 4 configured as a spherical shell 12 in the opening 41 and through the spherical calotte type bearing shell 13 of the housing 2 in the opening 42; in the pivot direction of the shaving head 4 and thus of the motor 15, this opening is enlarged relative to the cross-sectional dimensions of the motor 15 by an amount enabling the motor 15 to move freely in this direction. On the convex side of the spherical shell 12, two rib members 43 are provided on either side of the opening 41 for the motor 15—of which only one rib member 43 is shown in FIG. 11—, the rib members engaging into two correspondingly arranged guide slots 44 extended in length by the clearance necessary to allow movement of the shaving head 4. In this embodiment, too, the motor 15 is surrounded by a dish-shaped slide bearing member 18 held in relative sliding engagement with the convex side of the bearing shell 13 by a bushing 20 adapted to be threaded onto the motor 15. As illustrated in FIG. 1, a seal 22 is provided between the shaving head 4 and the housing 2. The radii $R_1$ and $R_2$ of the spherical shell 12 and the bearing shell 13, respectively, have their common center in pole 3.

Figure 12:
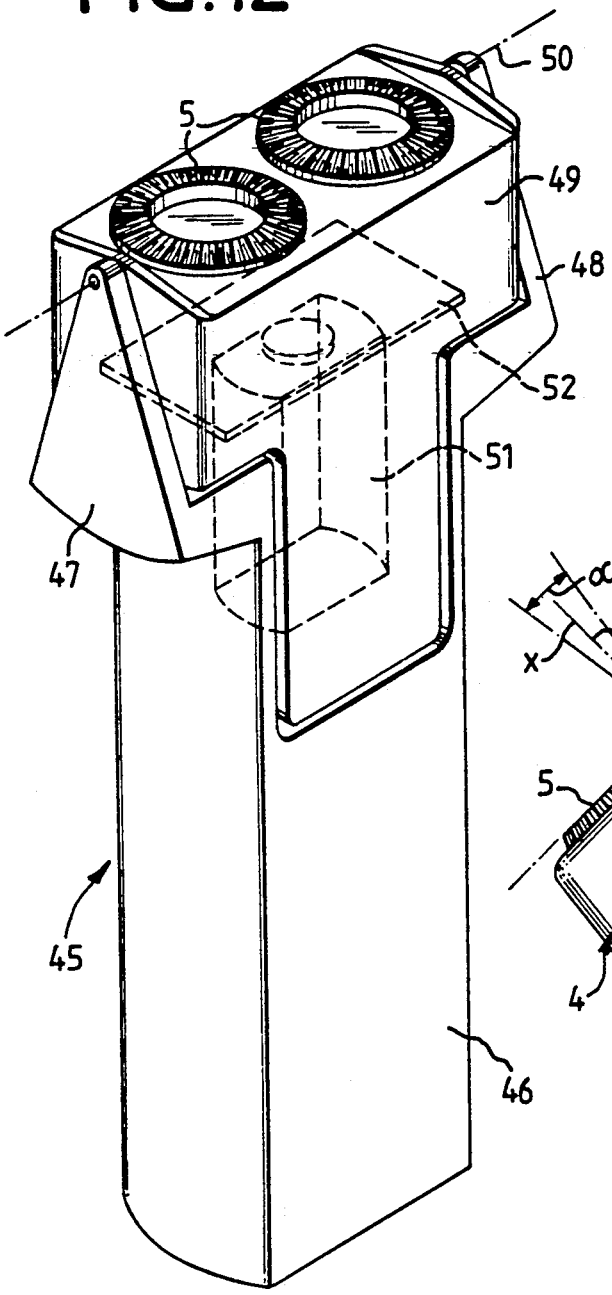
FIG. 12 is a modified structure of the embodiment of FIG. 11.

FIG. 12 shows a modified structure of an electrically driven dry shaving apparatus 45. Carried at the upper end of its housing 46 are two angular cheek structures 47 and 48 between which the shaving head 49 is pivotally mounted about a horizontal axis 50. The shaving assemblies 5 are arranged relative to the shaving head in the manner shown in FIG. 4, that is, the axis 50 is identical with the spatial axis x, passing through the pole 3 between the two shaving assemblies 5 which practically lies in the shearing plane E. The electric motor 51 is mounted on a drive plate 52 in the shaving head 49; for the sake of clarity, the gear connection to the shaving assemblies is not shown. To accommodate the motor 51, the housing of the shaving head 49 is extended in downward direction, with a corresponding recess being provided in the shaver body 46. If it is desired to avoid this structure, an obvious solution is to fixedly install the motor in the body 46 and to drive the shaving assemblies 5 by means of an appropriate linkage using, for example, a flexible shaft, a shaft with universal joints or bevel gearings, as known per se.

| List of References | |
|---|---|
| 1, 1.7 | Shaving Apparatus |
| 2, 2.7 | Housing |
| 3 | Pole |
| 4, 4.3, 4.4, 4.5, 4.6, 4.7 | Shaving Head |
| 5 | Shaving Assembly |
| 6 | Upper Cutter |
| 7 | Lower Cutter |
| 8 | Axis of Rotation |
| 9 | Outer Surface |
| 10 | Shaving Head Axis of Symmetry |
| 11 | Shaving Head Housing |
| 12, 12.7 | Spherical Shell |
| 13, 13.7 | Bearing Shell |
| 14 | Mount |
| 15, 15.7 | Electric Motor |
| 16 | Gearing |
| 17 | Opening in 13 |
| 18 | Slide Bearing Member |
| 19 | Inner Wall of 13 |
| 20 | Bushing |
| 21 | Stop Means |
| 22, 22.7 | Seal |
| 23 | Coupling Member |
| 24 | Longitudinal Side |
| 25 | Rib Member |
| 26 | Rib Member |
| 27 | Block |
| 28 | Block |
| 29 | Opening in 23 |
| 30 | Transverse Side |
| 31 | Opening in 12.7 |
| 32 | Recess in 12.7 |
| 33 | Recess in 12.7 |
| 34 | Recess in 12.7 |
| 35 | Recess in 12.7 |
| 36 | Opening in 13.7 |
| 37 | Recess in 13.7 |
| 38 | Recess in 13.7 |
| 39 | Bushing |
| 40 | Slide Bearing Member |
| 41 | Opening in 12, FIG. 11 |
| 42 | Opening in 13, FIG. 11 |
| 43 | Rib Members on 12 |
| 44 | Guide Slots in 13 |
| 45 | Shaving Apparatus, FIG. 12 |
| 46 | Shaver Body, FIG. 12 |
| 47 | Cheek Structure, FIG. 12 |
| 48 | Cheek Structure, FIG. 12 |
| 49 | Shaving Head, FIG. 12 |
| 50 | Axis, FIG. 12 |
| 51 | Electric Motor, FIG. 12 |
| 52 | Drive Plate, FIG. 12 |
| K | Circle Described by Wobbling Motion |
| E | Shearing Plane |
| $R_1$ | Radius of Spherical Shell 12 |
| $R_2$ | Radius of Bearing Shell 13 |
| $\alpha$ | Angle of Deflection of Wobbling Motion of Axis 10 |
| x, y, z | Spatial Axes |

We claim:

1. A dry shaving apparatus comprising a housing, a shaving head movably carried on said housing, said shaving head including at least one shaving assembly, said shaving assembly including a circular upper cutter and a rotary lower cutter, said lower cutter having an axis of rotation aligned at right angles to a shearing plane (E) extending parallel to the outer surface of said upper cutter, said shaving head having an axis of symmetry intersecting said shearing plane (E) at right angles in the geometric center of said shaving head, and structure supporting said shaving head on said housing so that said geometric center is provided as a stationary pole for said shaving head axis of symmetry which is movable with said shearing plane (E) in any direction, relative to the housing.

2. The dry shaving apparatus as claimed in claim 1 wherein said shearing plane (E) and said shaving head axis of symmetry are jointly movable about three spatial axes (x, y, z) passing through said stationary pole at relative right angles.

3. The dry shaving apparatus as claimed in claim 2 and further including stop means on said shaving head and said housing for limiting said joint movement of said shearing plane (E) and said shaving head axis of symmetry.

4. The dry shaving apparatus as claimed in claim 1 wherein said housing includes a bearing shell in the form of a spherical calotte, and said shaving head includes a spherical shell portion, and said spherical shell portion is pivotally mounted in said bearing shell.

5. The dry shaving apparatus as claimed in claim 4 and further including an annular seal between said spherical shell and said bearing shell, preferably in the outer periphery thereof.

6. A dry shaving apparatus comprising a housing, a shaving head movably carried on said housing, said shaving head including at least one shaving assembly, said shaving assembly including a circular upper cutter and a rotary lower cutter, said lower cutter having an axis of rotation aligned at right angles to a shearing plane (E) extending parallel to the outer surface of said upper cutter, said shaving head having an axis of symmetry intersecting said shearing plane (E) at right angles in the geometric center of said shaving head, and structure supporting said shaving head on said housing so that said geometric center is provided as a stationary pole for said shaving head axis of symmetry which is movable with said shearing plane (E) in any direction, relative to the housing of said shaving head supporting structure including a bearing shell, and said shaving head including a spherical shell portion that is pivotally mounted in said bearing shell, the radii ($R_1$, $R_2$) of said spherical shell and said bearing shell having their common center in said stationary pole.

7. A dry shaving apparatus comprising a housing, a shaving head movably carried on said housing, said shaving head including at least one shaving assembly, said shaving assembly including a circular upper cutter and a rotary lower cutter, said lower cutter having an axis of rotation aligned at right angles to a shearing plane (E) extending parallel to the outer surface of said upper cutter, said shaving head having an axis of symmetry intersecting said shearing plane (E) at right angles in the geometric center of said shaving head, and structure supporting said shaving head on said housing so that said geometric center is provided as a stationary pole for said shaving head axis of symmetry which is movable with said shearing plane (E) in any direction, relative to the housing of said shaving head supporting structure including a bearing shell, and said shaving head including a spherical shell portion that is pivotally mounted in said bearing shell, said housing including a mount, an electric motor for driving said lower cutter secured to said mount coaxially with said shaving head axis of symmetry, said motor extending with its free end into the interior of said housing through an opening in said bearing shell, a bushing secured to the free end of said motor and a dish-shaped slide bearing member between said bushing and said bearing shell whose dimension is larger than the dimension of said opening in said bearing shell, said slide bearing member being held in sliding engagement with the wall of said bearing shell by said bushing.

8. A dry shaving apparatus comprising a housing, said housing including a bearing shell and a mount for an electric motor, a shaving head that includes at least one shaving assembly, said shaving assembly including a circular upper cutter and a rotary lower cutter, said lower cutter having an axis of rotation aligned at right angles to a shearing plane (E) extending parallel to the outer surface of said upper cutter, said shaving head having an axis of symmetry intersecting said shearing plane (E) at right angles in the geometric center of said shaving head, and structure supporting said shaving head on said housing so that said geometric center is provided as a stationary pole for said shaving head axis of symmetry which is movable with said shearing plane (E), a motor secured to said mount with its free end extending through an opening in said bearing shell, the diameter of said opening in said bearing shell having positive allowance relative to the diameter of said motor which corresponds to the desired freedom of movement of said shaving head, and the periphery of said opening being stop structure for limiting the movement of said shaving head.

9. A dry shaving apparatus comprising a housing, said housing including a bearing shell in the form of a spherical calotte, a shaving head movably carried on said housing, said shaving head including a spherical shell portion and at least one shaving assembly, said spherical shell portion being pivotally mounted in said bearing shell, said shaving assembly including a circular upper cutter and a rotary lower cutter, said lower cutter having an axis of rotation aligned at right angles to a shearing plane (E) extending parallel to the outer surface of said upper cutter, said shaving head having an axis of symmetry intersecting said shearing plane (E) at right angles in the geometric center of said shaving head, said bearing shell and said spherical shell portion cooperating to support said shaving head on said housing so that said geometric center is provided as a stationary pole for said shaving head axis of symmetry which is movable with said shearing plane (E), the angle of deflection ($\alpha$) of the pivotal or wobbling movement (K) of said shaving head axis of symmetry together with said shearing plane (E) about said stationary pole amounting up to about 20°.

10. A dry shaving apparatus comprising a housing, a shaving head movably carried on said housing, said shaving head including at least one shaving assembly, said shaving assembly including a circular upper cutter and a rotary lower cutter, said lower cutter having an axis of rotation aligned at right angles to a shearing plane (E) extending parallel to the outer surface of said upper cutter, said shaving head having an axis of symmetry intersecting said shearing plane (E) at right angles in the geometric center of said shaving head, and structure supporting said shaving head on said housing so that said geometric center is provided as a stationary pole for said shaving head axis of symmetry which is movable with said shearing plane (E) in any direction, relative to the housing of said housing including a bearing shell, and said shaving head including a spherical shell portion that is pivotally mounted in said bearing shell, said shearing plane (E) and said shaving head axis of symmetry being jointly movable about three spatial axes (x, y, z) passing through said stationary pole at relative right angles, and positive-engagement guiding means in the region of said spherical shell of said shaving head and said bearing shell of said housing, said guiding means inhibiting at least one pivotal movement about one of said spatial axes.

11. The dry shaving apparatus as claimed in claim 10 and further including coupling structure engaging into said guiding means of said spherical shell and said bearing shell.

12. The dry shaving apparatus as claimed in claim 11 wherein said coupling structure is provided with rib members and blocks intersecting with each other at right angles, said coupling structure being mounted on the concave side of said spherical shell and, extending with said blocks through correspondingly dimensioned recesses in said spherical shell into engagement with said guiding means.

13. A dry shaving apparatus comprising a housing, said housing including a bearing shell, a shaving head that includes a spherical shell portion and at least one shaving assembly, said spherical shell portion being pivotally mounted in said bearing shell, said shaving assembly including a circular upper cutter and a rotary lower cutter, said lower cutter having an axis of rotation aligned at right angles to a shearing plane (E) extending parallel to the outer surface of said upper cutter, said shaving head having an axis of symmetry intersecting said shearing plane (E) at right angles in the geometric center of said shaving head, said bearing shell and said spherical shell portion supporting said shaving head on said housing so that said geometric center is provided as a stationary pole for said shaving head axis of symmetry which is movable with said shearing plane (E), and positive-engagement guiding means in the region of said spherical shell of said shaving head and said bearing shell of said housing, said guiding means allowing pivotal motion between said shaving head and said housing about one of the two spatial axes (x or y) lying in said shearing plane (E), while inhibiting movements about the other two spatial axes (y) or (x) and (z).

14. A dry shaving apparatus comprising a housing, a shaving head movably carried on said housing, said shaving head including at least one shaving assembly, said shaving assembly including a circular upper cutter and a rotary lower cutter, said lower cutter having an axis of rotation aligned at right angles to a shearing plane (E) extending parallel to the outer surface of said upper cutter, said shaving head having an axis of symmetry intersecting said shearing plane (E) at right angles in the geometric center of said shaving head, and structure supporting said shaving head on said housing so that said geometric center is provided as a stationary pole for said shaving head axis of symmetry which is movable with said shearing plane (E) in any direction, relative to the housing of said shearing plane (E) and said shaving head axis of symmetry being jointly movable about an axis passing through said stationary pole, and stop means on said shaving head and said housing for limiting said joint movement of said shearing plane (E) and said shaving head axis of symmetry.

15. The dry shaving apparatus as claimed in claim 14 wherein said housing includes a bearing shell in the form of a spherical calotte, and said shaving head includes a spherical shell portion, and said spherical shell portion is pivotally mounted in said bearing shell.

16. A dry shaving apparatus comprising a housing, said housing including a bearing shell in the form of a spherical calotte, a shaving head that includes a spherical shell portion and at least one shaving assembly, said spherical shell portion being pivotally mounted in said bearing shell, said shaving assembly including a circular upper cutter and a rotary lower cutter, said lower cutter having an axis of rotation aligned at right angles to a shearing plane (E) extending parallel to the outer surface of said upper cutter, said shaving head having an axis of symmetry intersecting said shearing plane (E) at right angles in the geometric center of said shaving head, and structure supporting said shaving head on said housing so that said geometric center is provided as a stationary pole for said shaving head axis of symmetry which is movable with said shearing plane (E) in any direction, relative to the housing the said bearing shell having their common center in said stationary pole.

17. A dry shaving apparatus comprising a housing, a shaving head movably carried on said housing, said housing including a bearing shell and a mount, an electric motor for driving said shaving assembly secured to said mount, a shaving head including at least one shaving assembly, said shaving assembly including a circular upper cutter and a rotary lower cutter, said lower cutter having an axis of rotation aligned at right angles to a shearing plane (E) extending parallel to the outer surface of said upper cutter, said shaving head having an axis of symmetry intersecting said shearing plane (E) at right angles in the geometric center of said shaving head, and structure supporting said shaving head on said housing so that said geometric center is provided as a stationary pole for said shaving head axis of symmetry which is movable with said shearing plane (E) in any direction, relative to the housing of said electric motor being secured coaxially with said shaving head axis of symmetry, and extending with its free end into the interior of said housing through an opening in said bearing shell, a bushing secured to the free end of said motor, and a dish-shaped slide bearing member between said bushing and said bearing shell whose dimension is larger than the dimension of said opening in said bearing shell, said slide bearing member being held in sliding engagement with the wall of said bearing shell by said bushing.

18. The dry shaving apparatus as claimed in claim 17 wherein the diameter of said opening in said bearing shell has positive allowance relative to the diameter of said motor which corresponds to the desired freedom of movement of said shaving head, and the periphery of said opening provides stop structure for limiting the movement of said shaving head.

19. The dry shaving apparatus as claimed in claim 18 wherein the angle of deflection ($\alpha$) of the pivotal or wobbling movement (K) of said shaving head axis of symmetry together with said shearing plane (E) about said stationary pole amounts to up to about 20°.

* * * * *

UNITED STATES PATENT AND TRADEMARK OFFICE

CERTIFICATE OF CORRECTION

PATENT NO. : 5,007,168

DATED : April 16, 1991

INVENTOR(S) : Werner Messinger et al.

It is certified that error appears in the above-identified patent and that said Letters Patent is hereby corrected as shown below:

Col. 11, claim 16, line 22, insert --radii ($R_1$, $R_2$) of said spherical shell and-- before "said".

Signed and Sealed this

First Day of September, 1992

*Attest:*

DOUGLAS B. COMER

*Attesting Officer*

*Acting Commissioner of Patents and Trademarks*